US010714042B2

(12) United States Patent
Shi et al.

(10) Patent No.: US 10,714,042 B2
(45) Date of Patent: Jul. 14, 2020

(54) DISPLAY PANEL DRIVING METHOD, DRIVING CIRCUIT, DISPLAY PANEL, AND DISPLAY DEVICE

(71) Applicants: BOE Technology Group Co., Ltd., Beijing (CN); Beijing BOE Optoelectronics Technology Co., Ltd., Beijing (CN)

(72) Inventors: Lingyun Shi, Beijing (CN); Guangquan Wang, Beijing (CN); Bo Gao, Beijing (CN); Tiankuo Shi, Beijing (CN); Zijiao Xue, Beijing (CN); Dong Chen, Beijing (CN); Wei Sun, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 94 days.

(21) Appl. No.: 15/776,141

(22) PCT Filed: Aug. 31, 2017

(86) PCT No.: PCT/CN2017/099967
§ 371 (c)(1),
(2) Date: May 15, 2018

(87) PCT Pub. No.: WO2018/133422
PCT Pub. Date: Jul. 26, 2018

(65) Prior Publication Data

US 2019/0259344 A1 Aug. 22, 2019

(30) Foreign Application Priority Data

Jan. 18, 2017 (CN) ..... 2017 1 0039425

(51) Int. Cl.
*G09G 3/36* (2006.01)
*G09G 3/20* (2006.01)

(52) U.S. Cl.
CPC ..... *G09G 3/3677* (2013.01); *G09G 3/20* (2013.01); *G09G 2310/0202* (2013.01);
(Continued)

(58) Field of Classification Search
None
See application file for complete search history.

(56) References Cited

U.S. PATENT DOCUMENTS 8,797,340 B2 * 8/2014 Slavenburg ..... G09G 5/001 345/204
8,866,833 B2 * 10/2014 Petersen ..... G09G 5/001 345/537

(Continued)

FOREIGN PATENT DOCUMENTS

CN 101582249 A 11/2009
CN 102592549 A 7/2012

(Continued)

OTHER PUBLICATIONS

International Search Report and Written Opinion, including English translation of Boxes I, II, V and V11 of the Written Opinion, for International Application No. PCT/CN2017/099967, dated Dec. 4, 2017, 19 pages.

*Primary Examiner* — Patrick F Marinelli
(74) *Attorney, Agent, or Firm* — Westman, Champlin & Koehler, P.A.

(57) ABSTRACT

The present disclosure provides a method of driving a display panel, a driving circuit, a display panel, and a display device. The method comprises: when a scene change is detected, determining whether a time when the scene change occurs is in a process of scanning a frame of display screen of a first scene; and if so, controlling a gate driving circuit (Continued)

to re-scan respective gate lines on the display panel sequentially, and controlling a source driving circuit to input display signals of a second scene to respective pixels connected to the respective gate lines, the second scene being different from the first scene.

14 Claims, 4 Drawing Sheets

(52) U.S. Cl.
CPC ..... *G09G 2310/0213* (2013.01); *G09G 2310/0237* (2013.01); *G09G 2310/0243* (2013.01); *G09G 2320/0626* (2013.01); *G09G 2320/103* (2013.01)

(56) References Cited

U.S. PATENT DOCUMENTS 9,311,864 B2 4/2016 Chu et al.
9,383,851 B2 * 7/2016 Wyatt ..... G06F 3/0412
9,495,928 B2 * 11/2016 Jiang ..... G09G 3/3674
9,818,375 B2 11/2017 Sone et al.
2011/0279464 A1 11/2011 Klask et al.
2013/0135270 A1 5/2013 Chu et al.
2014/0092113 A1 * 4/2014 Petersen ..... G09G 5/001 345/545
2014/0092150 A1 * 4/2014 Slavenburg ..... G09G 5/001 345/698
2014/0104243 A1 * 4/2014 Sakariya ..... G06F 3/14 345/204
2014/0320554 A1 * 10/2014 Takahashi ..... G09G 3/3611 345/690
2015/0193062 A1 * 7/2015 Wyatt ..... G06F 3/0412 345/173
2015/0194137 A1 * 7/2015 Wyatt ..... G09G 5/393 345/173
2015/0243253 A1 8/2015 Sone et al.
2015/0310820 A1 * 10/2015 Jiang ..... G09G 3/3674 345/173
2018/0374416 A1 * 12/2018 Hou ..... G09G 3/3225
2019/0114997 A1 * 4/2019 Okamoto ..... G09G 5/006

FOREIGN PATENT DOCUMENTS

CN 103714559 A 4/2014
CN 104662596 A 5/2015
CN 106710506 A 5/2017

* cited by examiner

DISPLAY PANEL DRIVING METHOD, DRIVING CIRCUIT, DISPLAY PANEL, AND DISPLAY DEVICE

CROSS-REFERENCE TO RELATED APPLICATION(S)

This application is a U.S. National Phase Application of International Application No. PCT/CN2017/099967, filed on Aug. 31, 2017, entitled "DISPLAY PANEL DRIVING METHOD, DRIVING CIRCUIT, DISPLAY PANEL, AND DISPLAY DEVICE," which claims priority to the Chinese Application No. 201710039425.7, filed on Jan. 18, 2017, both of which are incorporated herein by reference in their entirety.

TECHNICAL FIELD

The present disclosure relates to the field of display technology, in particular to a display panel driving method, a driving circuit, a display panel, and a display device.

BACKGROUND

In a normal Virtual Reality (VR) display system, discomfort may arise if movement of the human's head and rotation of eyeballs do not match with an image entering human eyes. Thus, fast follow-up and response time are very important for VR display.

In e.g. a VR display environment, a nine-axis sensor and infrared eye-tracking camera is generally used to collect a scenes focused by the human eyes. When a point focused by the eyeballs changes, a display panel may only scan a small portion of the scene. In conventional solutions, when the displayed scene changes, a Central Processing Unit (CPU) notifies a Graphics Processing Unit (GPU) of rendering a new image, but display information of a new scene cannot be sent until the display panel has finished scanning the previous frame of screen, which causes that the response time becomes slower, or even has nearly one frame of time wasted, affecting objective experience; otherwise, there will be a tearing effect.

Therefore, how to reduce the response time upon change of the scene is an urgent problem to be solved.

SUMMARY

In order to at least partially solve or reduce the problem of a long response time upon change of the scene in the related art, embodiments of the present disclosure provide a method of driving a display panel, a driving circuit, a display panel, and a display device.

An embodiment of the present disclosure provides a method of driving a display panel, comprising:

when a scene change is detected, determining whether a time when the scene change occurs is in a process of scanning a frame of display screen of a first scene; and if so, controlling a gate driving circuit to re-scan respective gate lines on the display panel sequentially, and controlling a source driving circuit to input a display signal of a second scene to respective pixels connected to the respective gate lines, the second scene being different from the first scene.

In a possible implementation, in the above method provided by the exemplary embodiment of the present disclosure, controlling the gate driving circuit to re-scan the respective gate lines on the display panel sequentially comprises:

inputting a frame start signal to the gate driving circuit.

In a possible implementation, in the above method provided by the exemplary embodiment of the present disclosure, controlling the source driving circuit to input the display signal of the second scene to the respective pixels connected to each of the respective gate lines comprises:

controlling the source driving circuit to input the corrected display signal of the second scene to data lines connected to the respective pixels.

In a possible implementation, in the above method provided by the exemplary embodiment of the present disclosure, controlling the gate driving circuit to re-scan the respective gate lines on the display panel sequentially comprises:

inputting a reset signal to the gate driving circuit; and inputting a frame start signal to the gate driving circuit after the gate driving circuit stops scanning.

In a possible implementation, the above method provided by the exemplary embodiment of the present disclosure further comprises:

turning off backlight of the display panel during the scanning of the gate driving circuit.

In a possible implementation, the above method provided by the exemplary embodiment of the present disclosure further comprises:

controlling backlight of the display panel to be turned on, after the gate driving circuit finishes scanning a frame of display screen of the second scene.

In a possible implementation, the above method provided by the exemplary embodiment of the present disclosure further comprises:

if it is determined that the time when the scene change occurs is not in the process of scanning the frame of display screen, controlling, at a next frame after the time, the source driving circuit to input the display signal of the second scene to the respective pixels connected to the respective gate lines.

An embodiment of the present disclosure further provides a driving circuit of a display panel, comprising:

a gate driver;

a source driver; and a controller, electrically connected to the gate driver and the source driver respectively and configured to:

when a scene change is detected, determine whether a time when the scene change occurs is in a process of scanning a frame of display screen of a first scene; and if so, control the gate driver to re-scan respective gate lines on the display panel sequentially, and control the source driver to input a display signal of a second scene to respective pixels connected to the respective gate lines, the second scene being different from the first scene.

In a possible implementation, in the above driving circuit provided by the exemplary embodiment of the present disclosure, the controller is configured to input a frame start signal to the gate driver; and the gate driver is configured to re-scan the respective gate lines on the display panel sequentially when receiving the frame start signal.

In a possible implementation, in the above driving circuit provided by the exemplary embodiment of the present disclosure, the source driver is configured to input the corrected display signal of the second scene to data lines connected to the respective pixels.

In a possible implementation, in the above driving circuit provided by the exemplary embodiment of the present disclosure, the controller is configured to input a reset signal to the gate driver and input a frame start signal to the gate driver after the gate driver stops scanning; and the gate driver is configured to stop scanning the respective gate lines on the display panel and reset, when the reset signal is received; and re-scan the respective gate lines on the display panel sequentially, when the frame start signal is received.

In a possible implementation, in the above driving circuit provided by the exemplary embodiment of the present disclosure, the controller is further configured to:

Control backlight of the display panel to be turned off during the scanning of the gate driver.

In a possible implementation, in the above driving circuit provided by the exemplary embodiment of the present disclosure, the controller is further configured to:

control backlight of the display panel to be turned on, after the gate driver finishes scanning a frame of display screen of the second scene.

In a possible implementation, in the above driving circuit provided by the exemplary embodiment of the present disclosure, the controller is further configured to:

if it is determined that the time when the scene change occurs is not in the process of scanning the frame of display screen, control, at a next frame after the time, the source driver to input the display signal of the second scene to the respective pixels connected to the respective gate lines.

An embodiment of the present disclosure further provides a display panel, comprising the above driving circuit.

An embodiment of the present disclosure further provides a display device, comprising the above display panel.

DETAILED DESCRIPTION

Figure 1:
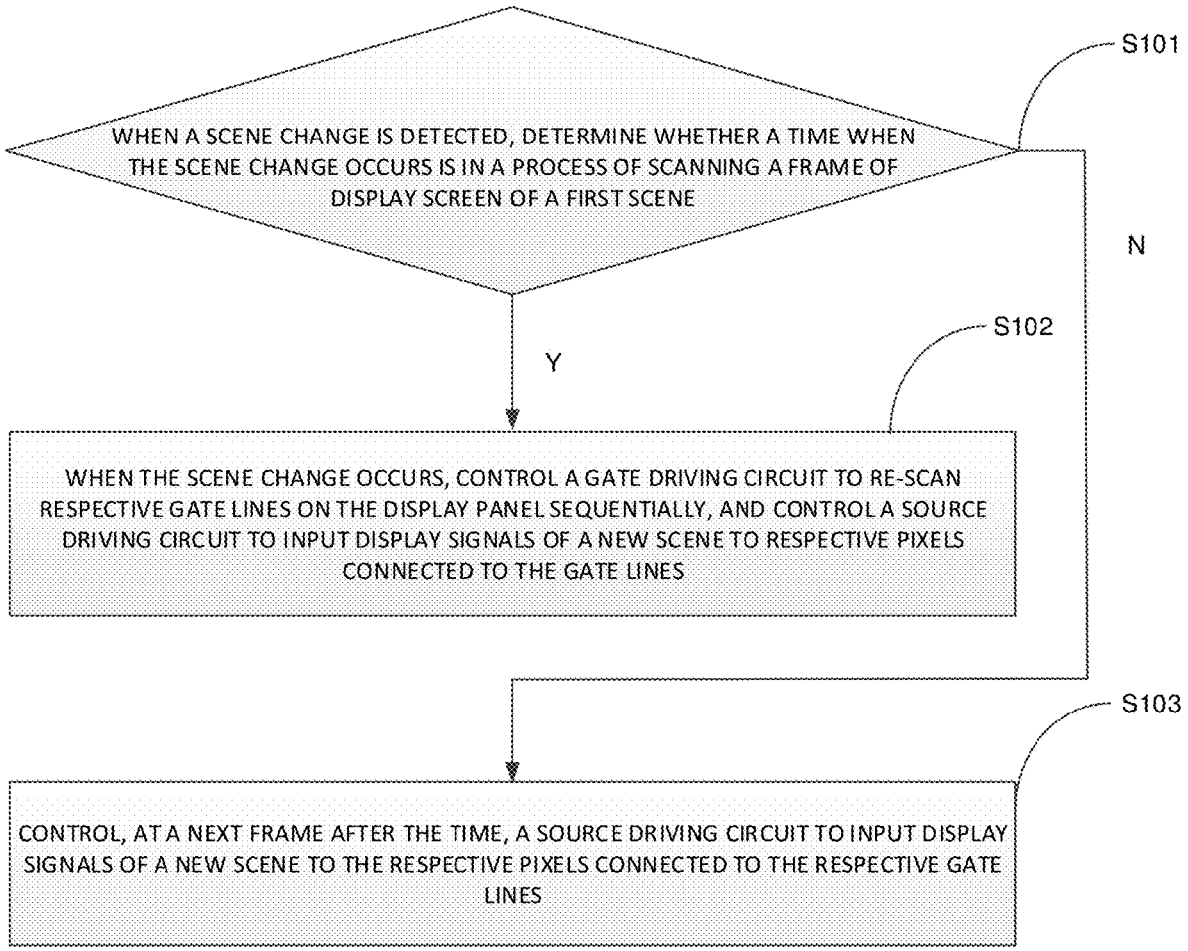
FIG. 1 is a flowchart of a method of driving a display panel according to an embodiment of the present disclosure.

In order to at least partially solve or reduce the problem of a long response time upon change of the scene in the related art, embodiments of the present disclosure provide a method of driving a display panel, a driving circuit, a display panel, and a display device.

Hereinafter, detailed description of a method of driving a display panel, a driving circuit, a display panel, and a display device provided by the embodiments of the present disclosure will be described in detail with reference to the accompanying drawings. Sizes and shapes of respective parts in the drawings are not drawn in actual scales, but are only intended to schematically illustrate the present disclosure.

An embodiment of the present disclosure provides a method of driving a display panel. As shown in FIG. 1, the method includes:

S101 of, when a scene change is detected, determining whether a time when the scene change occurs is in a process of scanning a frame of display screen of a first scene; and S102 of if so, controlling a gate driving circuit to re-scan respective gate lines on the display panel sequentially, and controlling a source driving circuit to input a display signal of a new scene (also referred to as a second scene) to respective pixels connected to the respective gate lines.

In the driving method provided by the embodiment of the present disclosure, when the scene change occurs, the respective gate lines on the display panel are re-scanned sequentially, and the display signal of the new scene is input to the respective pixels connected to the respective gate lines. As such, it is not necessary to scan the new scene after one frame of the old scene has been scanned completely, thereby reducing the response time, and improving the user experience. In some embodiments of the present disclosure, the term "scene" may refer to, e.g., a single still image displayed on the display panel or a moving image (e.g., video) composed of a series of related or similar images. In some embodiments, the change of the scene may refer to, e.g., changing a single still image to another single still image. In some other embodiments, the change of the scene may refer to, e.g., switching from a dynamic image composed of a series of related or similar images to another one dynamic image composed of another series of images whose correlation or similarity with the series of images exceeds a preset threshold. In some embodiments, a minimum interval for the re-scanning may be forcibly specified, in order to prevent a visual error resulting from the image being not refreshed completely due to too fast change of the scene. For example, in a case where consecutive multiple frames of images or scenes change so that each frame needs to be re-scanned, it may be specified that the re-scanning according to the above-described embodiment of the present disclosure may be performed every (N+1) frames, where N is an integer no smaller than 1. In some embodiments, N may be, e.g., 30 frames, 60 frames, 120 frames, or 144 frames, and the like. In this case, although the re-scanning is not performed immediately every time the scene change occurs, it is still possible to obtain a better response time compared to that in a case of no re-scanning.

In addition, the present disclosure is not limited thereto. In fact, the scene may be considered to change (regardless of actual difference between the old scene and the new scene), as long as it is deemed necessary to switch the scene. As a most extreme example, even if the images of the old scene and the new scene are the same, it is still possible to artificially switch the scenes and implement a scheme according to an embodiment of the present disclosure as described below.

Therefore, in some embodiments, the detection of the change of the scene may be implemented, e.g., by detecting presence of a data signal for the new scene, or, e.g., by detecting an instruction issued by a processor or a controller that provides the data signal for the new scene. In other embodiments, the detection of the change of the scene may also be implemented, e.g., by detecting a motion vector of a particular object in the scene. For example, when the motion vector of the particular object satisfies some predetermined criterion (e.g., a motion distance being larger than a predetermined threshold), it may be determined that the scene change occurs.

Figure 2A:
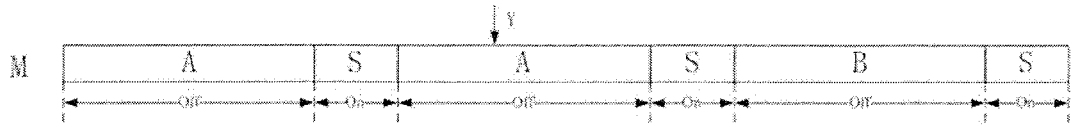
FIG. 2A (Related Art)
FIG. 2A is a scanning flowchart in the related art.
Figure 2B:
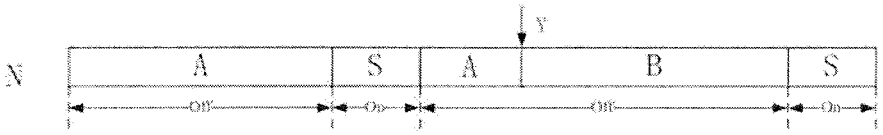
FIG. 2B is a scanning flowchart in an embodiment of the present disclosure.

FIGS. 2A and 2B are scanning flowcharts in the related art and in an embodiment of the present disclosure respectively. The scanning process M in FIG. 2A is a scanning process in the related art, and the scanning process N in FIG. 2B is a scanning process in a technical solution provided in the embodiment of the present disclosure. In FIGS. 2A and 2B, A represents a scanning time period of an old scene, B represents a scanning time period of a new scene, S represents a time period during which the backlight is on after the scanning of one frame of display image has been finished, Y represents a time when the scene change occurs, Off represents a time period during which the backlight is off, and On represents a time period during which the backlight is on. Referring to the scanning process M, the time when the scene change occurs is in a process of scanning a frame of display screen, the scanning of the new scene (or, the second scene) is not performed until the scanning of the frame of display screen of the old scene (or, the first scene) is finished (i.e., the second time period A in FIG. 2A) and the backlight is turned on to present the screen of the old scene to the human eyes; and after the scanning of a frame of display screen of the new scene is finished, the backlight is turned on, so that the human eyes can view the screen of the new scene. Referring to the scanning process N, the time when the scene change occurs is in a process of scanning a frame of display screen, the scanning of a display screen of the new scene is started from the time when the scene change occurs (i.e., the time period B in FIG. 2B), and the backlight is turned on after the scanning of a frame of display screen of the new scene is finished, and the screen of the new scene is viewed by the human eyes. Comparing the scanning process M and the scanning process N, it can be clearly seen that the driving method provided by the embodiment of the present disclosure may save a time for nearly a half of the frame. The scanning process N not only saves the time, but also can avoid invalid display information (i.e., the screen of the old scene after the scene change occurs) to be presented to the human eyes, and can prevent a dizziness effect.

Further, in the method of driving the display panel provided by the embodiment as shown in FIG. 1 described previously, the method may further include:

S103 of if it is determined that the time when the scene change occurs is not in the process of scanning the frame of display screen of the first scene, controlling, at a next frame after the time, the source driving circuit to input the display signal of the new scene (or, the second scene) to the respective pixels connected to the respective gate lines.

In the above step S101, it is firstly determined whether the time when the scene change occurs is in the process of scanning one frame of display screen, that is, whether the time when the scene change occurs is within the time period A (with reference to FIG. 2); if so, step S102 is performed; if not, step S103 is performed, that is, at the next frame after the time, the source driving circuit is controlled to input the display signal of the new scene to the respective pixels connected to the respective gate lines. For example, if the time when the scene change occurs is within the time period B during which the backlight is on, the display signal of the new scene is input upon scanning of the next frame, and the human eyes can view the screen of the new scene when the backlight is turned on again. If the time when the scene change occurs is at a boundary between the time period A and the time period S, a first case is the time being located at a position where the time period A starts, in which case, if the scanning of the old scene has already been started (i.e., within the time period A), step S102 is performed; and if the scanning of the old scene has not been started yet, the display signal of the new scene is directly input so that the screen of the new scene is displayed when the backlight is turned on. A second case is the time being located at a position where the time period A ends, in which case, when a next frame is being scanned, the display signal of the new scene is input so that the screen of the new scene is displayed when the backlight is turned on.

Figure 3:
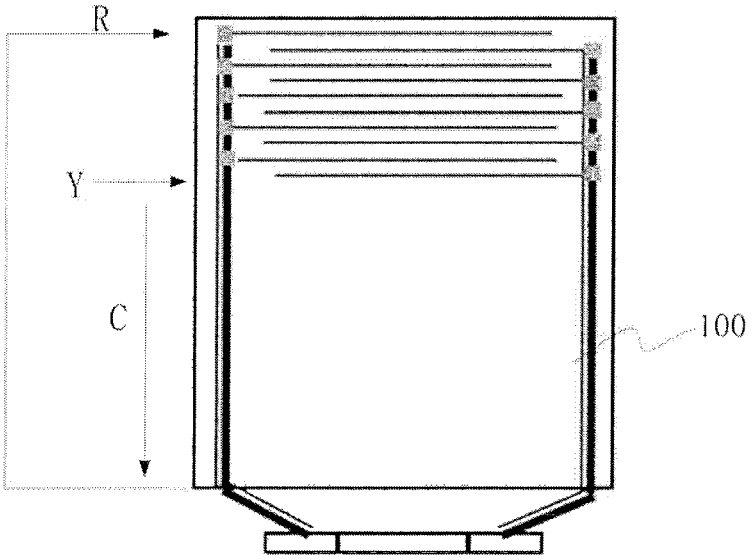
FIG. 3 (Related Art)
FIG. 3 is a schematic diagram of a scanning process in the related art.

FIG. 3 is a schematic diagram of scanning in the related art when a scene change occurs. As seen from FIG. 3, when the scene change occurs, e.g., the scene change occurs upon scanning to a position indicated by an arrow Y in FIG. 3, the gate driving circuit may keep scanning (as shown by an arrow C in FIG. 3); after a full-screen scanning of the display panel 100 has been finished, the backlight is turned on to present the screen of the old scene to the human eyes; then the backlight is turned off, and a Start Vertical (STV) signal is input to the gate driving circuit, controlling the gate driving circuit to reset and restart scanning of the gate lines on the display panel 100; and a display signal of a new scene is input to the source driving circuit, referring to an arrow R in FIG. 3. Since the scene has changed, the display signal of the old scene has been invalidated, and does not need to be presented to the human eyes to display an invalid image, which not only wastes time but also reduces a response speed, and may also cause the viewer to have dizziness.

In the method of driving the display panel provided by the embodiment of the present disclosure as described above, there are at least two implementations as follows.

Specifically, in some embodiments, in the method of driving the display panel provided by the embodiment of the present disclosure as described above, controlling the gate driving circuit to re-scan the respective gate lines on the display panel sequentially includes:

inputting a frame start signal (a STV signal) to the gate driving circuit.

By inputting the STV signal to the gate driving circuit, the gate driving circuit is triggered to start scanning of a new frame, so as to sequentially open the respective gate lines on the display panel. It should be noted that an order of scanning by the gate driving circuit may be scanning from the first line to the last line, or scanning from the last line to the first line. Of course, the scanning may also start from some line in the middle. The order of scanning is limited herein.

Figure 4:
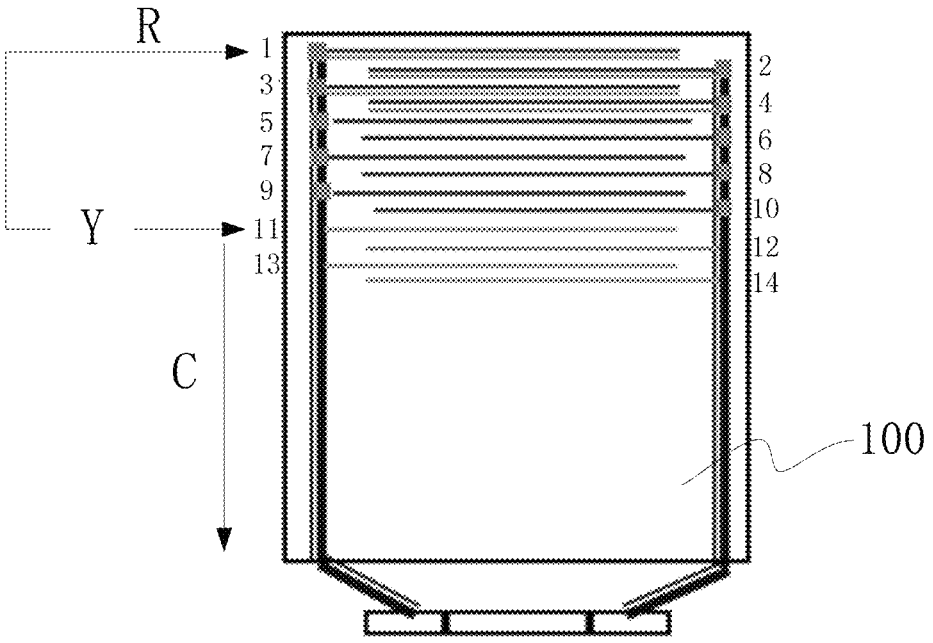
FIG. 4 is a schematic diagram of a scanning process in an embodiment of the present disclosure.

As shown in FIG. 4, when the scene change occurs (e.g., an arrow Y in FIG. 4), the CPU notifies the GPU of rendering an image of a new scene, and the GPU controls a driver chip to send an STV signal to the gate driving circuit, so as to control the gate driving circuit to re-scan (referring to an arrow R in FIG. 4). The GPU needs a relatively short time to render a new image, typically in 2 ms. The gate driving circuit is preferably a Gate Driver on Array (GOA) circuit. In the embodiments of the present disclosure, the GOA circuit is used as an example of the gate driving circuit for illustration. The GOA circuit generally includes a plurality of GOA units. With reference to FIG. 4, in an actual scanning process, a part of GOA units may be arranged on the left side of the display panel 100, and another part of GOA units may be arranged on the right side of the display panel 100, resulting in alternating scanning lines as shown in FIG. 4.

As shown in FIG. 4, dark scanning lines in FIG. 4 are scanning lines before the scene change occurs, and light scanning lines are scanning lines after the scene change occurs. The scanning lines are numbered in FIG. 4 for clearer illustration. After receiving the STV signal, the gate driving circuit re-scans the gate lines on the display panel 100, but the scanning of the previous frame of old scene does not stop (referring to an arrow C in FIG. 4). As such, the gate driving circuit scans two rows of gate lines simultaneously. For example, the scanning proceeds to the 10th row before the scene change occurs; and after the scene change occurs, the gate driving circuit scans the $1^{st}$ row and the $11^{th}$ row simultaneously, the $2^{nd}$ row and the $12^{th}$ row simultaneously, and so on. The gate driving circuit may not scan one row at a time until the scanning of the old scene is finished.

While the gate driving circuit scans, the source driving circuit is controlled to input the display signal of the new scene to the respective pixels connected to the respective gate lines, i.e., inputs the display signal of the new scene to respective data lines connected to the pixels, which is a process of charging the pixels. Generally, a data line is connected to sources of a column of pixels, and a gate line is connected to gates of a row of pixels. After the respective gates are open, thin film transistors are turned on, and the display signal of the image may be input to the sources of the pixels through the data lines, and are output to pixel electrodes through drains. As such, a voltage corresponding to the display signal may be applied across the pixel electrodes. Since a constant voltage is generally applied to a common electrode, a stable electric field is formed between the pixel electrode and the common electrode, thereby driving liquid crystal to make a certain deflection.

Based on the above analysis, since the gate driving circuit scans two rows of gate lines simultaneously, the source driving circuit may input the display signal of the new scene to the two rows simultaneously, i.e., charging two rows of pixels simultaneously, which may affect display of the image of the new scene. For example, since there is no discharging process before the re-scanning, it may result in excessive charging, and it may also result in insufficient charging due to charging two rows simultaneously. In order to prevent the image of the new scene from being affected, the display signal input by the source driver circuit needs to be compensated, which specifically includes:

controlling source driving circuit to input the corrected display signal of the new scene to the data lines connected to the respective pixels.

By inputting the corrected display signal of the new scene to the data lines connected to the pixels, the display signal input in the re-scanned rows of pixels is a signal required to display the new scene, so as to ensure a normal display of the image of the new scene. For example, the source driving circuit inputs the corrected display signal of the new scene to the $1^{st}$ and the $11^{th}$ rows simultaneously, and the display signal is a display signal required for the normal display of the $1^{st}$ row of pixels.

In a particular implementation, in the scanning process of the gate driving circuit, the backlight of the display panel 100 is turned off, and the backlight is not turned on until the scanning of one frame of display screen is finished. After the gate driving circuit re-scans, wrong display information presented may be overwritten until the scanning of the last line is finished, and the human eyes view a pattern of the new scene after the backlight is turned on. Thus, the wrong information appearing during the scanning may not presented to the human eyes.

Also referring to FIG. 4, since the scene change occurs, the image displayed by the scanning of the old scene before the scene change occurs may be regarded as the wrong display information. After the scene change occurs, the image displayed by the scanning of the old scene which is not stopped is also the wrong display information. Although the input display signal is a display signal of the new scene, the display position and the size of the display signal are not correct, e.g., the display signal of the $11^{th}$ row being the same as the display signal of the $1^{st}$ row, and at this time, the image displayed on the $11^{th}$ row being the image that should be displayed on the $1^{st}$ row, thus it is also the wrong display information. After the gate driving circuit re-scans, the wrong display information may be continuously overwritten until the scanning of this frame is finished.

Additionally, in other embodiments of the present disclosure, in the method of driving the display panel provided by the embodiment of the present disclosure as described above, controlling the gate driving circuit to re-scan the respective gate lines on the display panel sequentially includes:

inputting a reset signal to the gate driving circuit; and inputting a frame start signal is input to the gate driving circuit after the gate drive circuit stops scanning.

Figure 5:
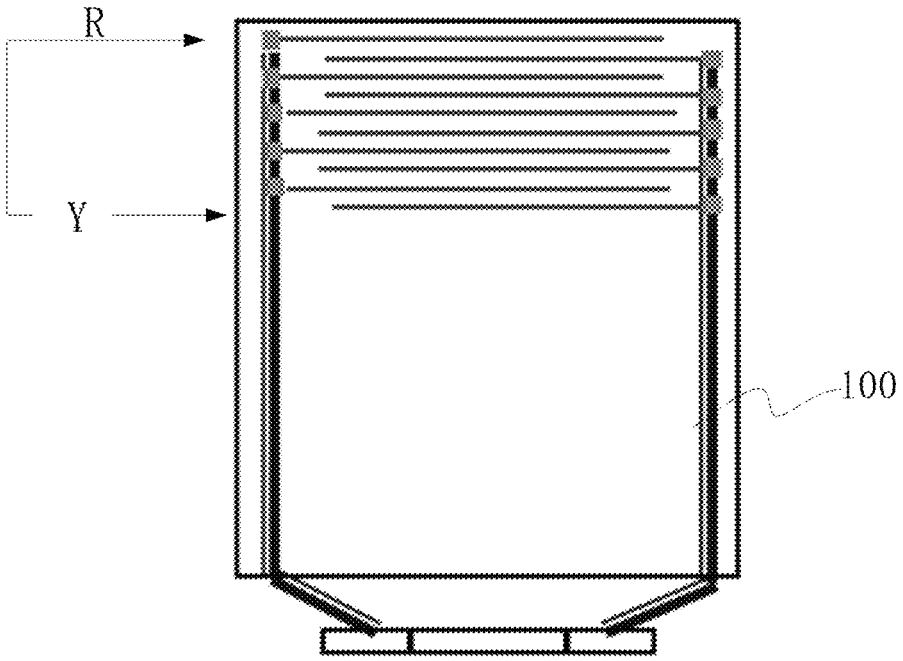
FIG. 5 is a schematic diagram of a scanning process in another embodiment of the present disclosure.

As shown in FIG. 5, when the scene change occurs, e.g., at an arrow Y in FIG. 5, the reset signal is input to the gate driving circuit to control the gate driving circuit to stop scanning and reset (as shown in an arrow R in FIG. 5), then the STV signal is input to control the gate driving circuit to re-scan. This avoids the simultaneous scanning of two rows of gate lines that occurs in the embodiments as previously described. In a particular implementation, the GOA circuit may be reset by enabling Abnormal Power Off (APO) of the GOA circuit, and an APO timing sequence needs to be inserted in the timing of the GOA.

More specifically, in the above APO method of GOA, all of the gates on the display panel 100 may be turned on, and all of the data lines may be grounded, so that the respective pixels on the display panel 100 may be discharged, which avoids influence of the remaining power in the pixels on the next frame of display signal.

Further, the above method of driving the display panel provided by the embodiment of the present disclosure as described regardless of any implementations as previously discussed may further include:

controlling the backlight of the display panel to be turned on, after the gate driving circuit finishes scanning one frame of display screen of the new scene.

In order to prevent the wrong display information appearing in the scanning process of the gate driving circuit from being presented to the human eyes, the backlight is off during the scanning process of the gate driving circuit; and the backlight of the display panel is controlled to be turned on, after the scanning of one frame of display screen of the new scene is finished, so as to present a complete image after completion of the scanning to the human eyes.

Based on the same disclosed concept, an embodiment of the present disclosure further provides a driving circuit of a display panel. Since the principle of the driving circuit to solve the problem is similar with that of the driving method as described above, the implementation of the driving circuit may refer to the implementation of the driving method as described above, and thus repeated description will be omitted here.

Figure 6:
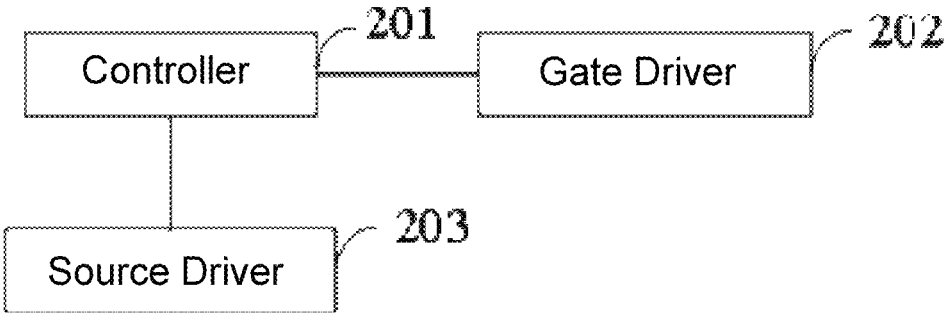
FIG. 6 is a structural schematic diagram of a driving circuit of a display panel provided by an embodiment of the present disclosure.

The embodiment of the present disclosure provides a driving circuit of a display panel. As shown in FIG. 6, the driving circuit may include: a controller (or a control circuit) 201, and a gate driver (or a gate driving circuit) 202 and a source driver (or a source driving circuit) 203 which are electrically connected to the controller 201 respectively.

The controller 201 may be configured to determine whether a time when a scene change occurs is in a process of scanning a frame of display screen of a first scene, when it is detected that the scene change occurs; and if so, control the gate driver 202 to re-scan respective gate lines on the display panel sequentially, and control the source driver 203 to input a display signal of a new scene or a second scene to respective pixels connected to the respective gate lines.

Specifically, the above controller 201 may be implemented by a driver chip. The above gate driver 202 may be implemented by a gate driving circuit (e.g., a GOA circuit), and the above source driver 203 may be implemented by a source driving circuit.

Further, in the driving circuit of the display panel provided by the embodiment of the present disclosure as described above, the controller 201 may be configured to input a frame start signal to the gate driver 202; and the gate driver may be configured to re-scan the respective gate lines on the display panel sequentially when receiving the frame start signal.

Specifically, in the driving circuit of the display panel provided by the embodiment of the present disclosure as described above, the source driver 203 may be configured to input the corrected display signal of the new scene to data lines connected to the respective pixels.

Further, in the driving circuit of the above display panel provided by the embodiment of the present disclosure as described above, the controller 201 may be configured to input a reset signal to the gate driver 202 and input a frame start signal to the gate driver 202 after the gate driver 202 stops scanning; and the gate driver 202 may be configured to stop scanning the respective gate lines on the display panel and reset, when the reset signal is received; and re-scan the respective gate lines on the display panel sequentially, when the frame start signal is received.

Still further, in the driving circuit of the display panel provided by the embodiment of the present disclosure as described above, the controller 201 may also be configured to:

control the backlight of the display panel to be turned on, after the gate driver 202 finishes scanning one frame of display screen of the new scene.

In a particular implementation, in the driving circuit of the above display panel provided by the embodiment of the present disclosure as described above, the controller 201 may also be configured to:

if it is determined that the time when the scene change occurs is not in the process of scanning the frame of display screen, control, at a next frame after the time, the source driver 203 to input the display signal of the new scene to the respective pixels connected to the respective gate line.

Based on the same disclosed concept, an embodiment of the present disclosure further provides a display panel including the driving circuit as described above. Since the principle of the display panel to solve the problem is similar with that of the driving circuit as described above, the implementation of the display panel may refer to the implementation of the driving circuit as described above, and thus repeated description will be omitted here.

Based on the same disclosed concept, an embodiment of the present disclosure provides a display device including the display panel as described above. The display device may be applied to any product or component with a display function, such as a mobile phone, a tablet computer, a TV, a display, a notebook computer, a digital photo frame, a navigator etc. Since the principle of the display device to solve the problem is similar with that of the display panel as described above, the implementation of the display device may refer to the implementation of the display panel as described above, and thus repeated description will be omitted here.

A method of driving a display panel, a driving circuit, a display panel, and a display device of a display panel are provided by the embodiments of the present disclosure. The driving method includes: when a scene change is detected, determining whether a time when the scene change occurs is in a process of scanning a frame of display screen of a first scene; and if so, controlling a gate driving circuit to re-scan respective gate lines on the display panel sequentially, and controlling a source driving circuit to input a display signal of a new scene to respective pixels connected to the respective gate lines. According to the driving method, the driving circuit, the display panel, and the display device provided by the embodiments of the present disclosure, when the scene change occurs, the respective gate lines on the display panel are re-scanned sequentially, and the display signal of the new scene is input to the respective pixels connected to the respective gate lines. As such, it is not necessary to scan the new scene after one frame of the old scene has been scanned completely, thereby reducing the response time, and improving the user experience.

It will be apparent to the skilled in the art that various modifications and variations may be made in the present disclosure without departing from the spirit and scope of the disclosure. Thus, if these modifications and variations of the present disclosure fall within the scope of the claims of the present disclosure and their equivalents, the present disclosure is also intended to include these modifications and variations.

We claim:

1. A method of driving a display panel, the method comprising:

when a scene change is detected, determining whether a time when the scene change occurs is in a process of scanning a frame of display screen of a first scene; and when it is determined that the time when the scene change occurs is in the process of scanning the frame of display screen of the first scene, controlling a gate driving circuit to re-scan respective gate lines on the display panel sequentially, and controlling a source driving circuit to input display signals of a second scene to respective pixels connected to the respective gate lines, the second scene being different from the first scene;

wherein controlling the gate driving circuit to re-scan the respective gate lines on the display panel sequentially comprises:

inputting a reset signal to the gate driving circuit; and inputting a frame start signal to the gate circuit after the gate driving circuit stops scanning.

2. The method according to claim 1, wherein controlling the gate driving circuit to re-scan the respective gate lines on the display panel sequentially comprises:

inputting a frame start signal to the gate driving circuit.

3. The method according to claim 2, wherein controlling the source driving circuit to input the display signals of the second scene to the respective pixels connected to the respective gate lines comprises:

controlling the source driving circuit to input the corrected display signals of the second scene to data lines connected to the respective pixels.

4. The method according to claim 1, further comprising:

turning off backlight of the display panel during the scanning of the gate driving circuit.

5. The method according to claim 1, further comprising:

controlling backlight of the display panel to be turned on, after the gate driving circuit finishes scanning a frame of display screen of the second scene.

6. The method according to claim 1, further comprising:

if it is determined that the time when the scene change occurs is not in the process of scanning the frame of display screen, controlling, at a next frame after the time, the source driving circuit to input the display signals of the second scene to the respective pixels connected to the respective gate lines.

7. A driving circuit for a display panel, the driving circuit comprising:

a gate driver;

a source driver; and a controller electrically connected to the gate driver and the source driver, respectively, and configured to:

when a scene change is detected, determine whether a time when the scene change occurs is in a process of scanning a frame of display screen of a first scene; and when it is determined that the time when the scene change occurs is in the process of scanning the frame of display screen of the first scene, control the gate driver to re-scan respective gate lines on the display panel sequentially, and control the source driver to input display signals of a second scene to respective pixels connected to the respective gate lines, the second scene being different from the first scene:

wherein the controller is configured to input a reset signal to the gate driver and input a frame start signal to the gate driver after the gate driver stops scanning; and the gate driver is configured stop scanning the respective gate lines on the display panel and reset when the reset signal is received; and re-scan the respective gate lines on the display panel sequentially, when the frame start signal is received.

8. The driving circuit according to claim 7, wherein the controller is configured to input a frame start signal to the gate driver; and the gate driver is configured to re-scan the respective gate lines on the display panel sequentially when receiving the frame start signal.

9. The driving circuit according to claim 8, wherein the source driver is configured to input the corrected display signals of the second scene to data lines connected to the respective pixels.

10. The driving circuit according to claim 7, wherein the controller is further configured to:

control backlight of the display panel to be turned off during the scanning of the gate driver.

11. The driving circuit according to claim 7, wherein the controller is further configured to:

control backlight of the display panel to be turned on, after the gate driver finishes scanning a frame of display screen of the second scene.

12. The driving circuit according to claim 7, wherein the controller is further configured to:

if it is determined that the time when the scene change occurs is not in the process of scanning the frame of display screen, control, at a next frame after the time, the source driver to input the display signals of the second scene to the respective pixels connected to the respective gate lines.

13. A display panel comprising the driving circuit according to claim 7.

14. A display device comprising the display panel according to claim 13.

* * * * *